US006312176B2

(12) United States Patent
Kageyama et al.

(10) Patent No.: US 6,312,176 B2
(45) **Date of Patent: *Nov. 6, 2001**

(54) KEYBOARD APPARATUS

(75) Inventors: Masaaki Kageyama; Shouji Suganami; Seiichi Suga; Tsuyoshi Narusawa; Teruyasu Fukuyama, all of Fukushima-ken (JP)

(73) Assignee: Alps Electric Co., Ltd., Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/283,683

(22) Filed: Apr. 1, 1999

(30) Foreign Application Priority Data

Apr. 2, 1998 (JP) ..... 10-090005

(51) Int. Cl.[7] ..... B41J 5/08
(52) U.S. Cl. ..... 400/472; 400/496
(58) Field of Search ..... 400/472, 496, 400/494, 491; 341/22, 34, 20, 21; 200/344, 345, 341, 275

(56) References Cited

U.S. PATENT DOCUMENTS

| | | | | |
|---|---|---|---|---|
| 5,278,372 | * | 1/1994 | Takagi et al. | 200/344 |
| 5,278,374 | * | 1/1994 | Takagi et al. | 200/513 |
| 5,463,195 | * | 10/1995 | Wantanabe et al. | 200/5 A |
| 5,504,283 | | 4/1996 | Kako et al. . | |
| 5,625,532 | * | 4/1997 | Sellers | 361/680 |
| 5,842,798 | * | 12/1998 | Su | 400/491.2 |
| 5,850,194 | * | 12/1998 | Lin | 341/22 |
| 5,994,655 | * | 11/1999 | Tsai | 200/344 |

* cited by examiner

*Primary Examiner*—John S. Hilten
*Assistant Examiner*—Darius Cone
(74) *Attorney, Agent, or Firm*—Brinks Hofer Gilson & Lione

(57) ABSTRACT

A keyboard apparatus permits easier installation of slide retaining pins to a retaining portion and prevents intrusion of dust into the keyboard apparatus from the back surface of a supporting substrate thereof. A first retaining portion has a narrow area and a wide area, and slide retaining pins are latched in the wide area. A dust-proof sheet is provided on the bottom surface of a supporting substrate to cover through holes in the supporting substrate, the through holes resulting from the formation of the first retaining portion and second retaining portions.

8 Claims, 6 Drawing Sheets

KEYBOARD APPARATUS

BACKGROUND OF THE INVENTION

1. Field of the Invention

The present invention relates to a keyboard apparatus ideally used for a personal computer of a notebook type or the like for which thinness is required.

2. Description of the Related Art

A conventional keyboard apparatus will be described in conjunction with the accompanying drawings. FIG. 6 is a partial sectional view of the conventional keyboard apparatus, and FIG. 7 is a sectional view taken at the line 7—7 of FIG. 6. FIG. 8 is a schematic representation of a supporting substrate used for the conventional keyboard apparatus, wherein FIG. 8A is a partial top plan view of the supporting substrate, and FIG. 8B is a sectional view taken at the line 8B—8B of FIG. 8A.

A plate-like supporting substrate 51 made of a metal has: a pair of rectangular slits 51*a* and two pairs of rectangular slits 51*b* provided in parallel; a first retaining portion 51*c* which is positioned between the paired slits 51*a*, provided by cutting and raising a square wall so that it protrudes upward, and has a trapezoidal section; two second retaining portions 51*d*, each of which is positioned between the slits 51*b* of each pair, provided by cutting raising square walls so that they protrude upward, and have U-shaped sections; and vertical through holes 51*e* formed by providing the slits 51*a* and 51*b*, the first retaining portion 51*c*, and the second retaining portions 51*d*.

The single first retaining portion 51*c* and the two second retaining portions 51*d* are disposed triangularly on the supporting substrate 51. A plurality of sets, each set consisting of the three retaining portions, are formed on the supporting substrate 51.

A contact sheet 52 composed of two layers of flexible resinous films (not shown) has printed contacts on two opposing surfaces of the resinous films disposed with a predetermined gap provided therebetween. The sheet 52 has a plurality of apertures 52*a*. The first retaining portion 51*c* and the second retaining portions 51*d* are mounted on the supporting substrate 51, being inserted in the respective apertures 52*a*.

A link assembly L formed of a synthetic resin is constituted by a first supporting member 53 and a second supporting member 54. The first supporting member 53 is composed of: a plate-like base 53*a;* a round aperture 53*b* provided at the center of the base 53*a;* pivot shafts 53*c* installed on both sides at the center of the base 53*a;* a rotary shaft 53*d* which is provided about the pivot shafts 53*c* and which projects from the sidewall of one end of the base 53*a;* a pair of arms 53*e* which are provided around the pivot shaft 53*c,* coupled to the base 53*a* on the opposite side thereof, and protrude in parallel to each other; and slide retaining pins 53*f* provided so that they protrude inward with respect to the ends of the arms 53*e*.

The second supporting member 54 is constituted by a base 54*a,* a pair of arms 54*b* which are formed approximately in a U shape by being coupled to the base 54*a* and which are provided in parallel to each other, a slide pin 54*c* provided in such a manner that it protrudes outward on the free end of each of the arms 54*b;* a pair of pivot apertures 54*d* provided at the middle of each of the arms 54*b* such that they face each other; and a T-shaped rotary retaining pin 54*e* which is coupled to the base 54*a* and extends in the opposite direction from the arms 54*b*.

The first supporting member 53 and the second supporting member 54 are connected by the pivot shafts 53*c* that are fitted from inside into the pivot apertures 54*d* so that they intersect with each other. The slide retaining pin 53*f* is slidably retained in the single first retaining portion 51*c*, and the rotary retaining pin 54*e* is rotatably retained and held in the two second retaining portions 51*d*, thus configuring a set retaining portions of the link assembly L.

A key top 55 composed of a molding made of a synthetic resin has supporting portions 55*a* and 55*b* on the bottom surface thereof. The rotary shaft 53*d* of the first supporting member 53 and the slide pin 54*c* of the second supporting member 54 are retained by the supporting portions 55*a* and 55*b,* respectively.

A rubber spring 56 formed of a rubber constituent is constructed of a dome portion 56*a* that has a section shaped like an inverted U and a flat top surface, a cylindrical contact portion 56*b* provided on the top of the dome portion 56*a,* and a protuberance 56*c* provided so that it protrudes downward in the dome portion 56*a*. The bottom of the dome portion 56*a* of the rubber spring 56 is fixed onto the sheet 52 by an appropriate means, and the dome portion 56*a* is inserted in the round aperture 53*b* of the first supporting member 53 so that the contact portion 56*b* comes in contact with the bottom surface of the key top 55. The springiness of the dome portion 56*a* urges the link assembly L and the key top 55 upward at all times. At this time, the protuberance 56*c* provided on the dome portion 56*a* is positioned above the sheet 52.

A plurality of the link assemblies L, the key tops 55, the rubber springs 56 configured as discussed above are arranged on the supporting substrate 51 and the sheet 52 to make up the keyboard apparatus. This keyboard apparatus is installed on a personal computer or the like. In using the personal computer, when the key top 55 is pressed downward against the springiness of the rubber spring 56, the link assembly L moves down with the intersecting point as its center. At this time, the slide retaining pin 53*f* slides in the first retaining portion 51*c*, while the slide pin 54*c* slides in the supporting portion 55*b,* causing the link assembly L to be collapsed. This squeezes and deforms the dome portion 56*a,* causing the protuberance 56*c* to push the contact sheet 52. The pushing force turns ON the contact provided on the sheet 52, so that the input signal of the key is transmitted to a control member (not shown) of the personal computer or the like. The moment the key top 55 is released, the deformed dome portion 56*a* resets itself by its own springiness, the link assembly L and the key top 55 accordingly restore their original conditions, and the contact of the sheet 52 turns OFF. In this way, the contact is turned ON/OFF.

In the process for assembling the conventional keyboard apparatus described above, to dispose the slide retaining pin 53*f* such that it is held by the first retaining portion 51*c*, the arms 53*e* of the first supporting member 53 are flexibly spread outward to insert them into the first retaining portion 51*c* to hold them therein. Similarly, in order to dispose the rotary retaining pin 54*e* so that it is held in the second retaining portion 51*d*, the arms 54*b* of the second supporting members 54 are flexed inward to insert them into the second retaining portions 51*d* to hold them therein.

The first retaining portion 51*c*, however, has the following disadvantage because of its square shape. In the assembly process of the conventional keyboard apparatus, the two arms 53*e* provided with the slide retaining pins 53*f* have to be flexed to insert them into the first retaining portion 51*c* as described above, resulting in poor assemblability.

Further, the slits 51*a* and 51*b* are formed in the supporting substrate 51, then the wall between the slits are cut and raised to form the first retaining portion 51*c* and the second retaining portions 51*d*. As a result, the through holes 51*e* are formed in the supporting substrate 51 as mentioned above. Dust intrudes into the keyboard apparatus from the back face of the supporting substrate 51, adversely affecting the operation or the like of the link assembly L.

SUMMARY OF THE INVENTION

Accordingly, the present invention has been made with a view toward solving the problems described above, and it is an object thereof to provide a keyboard apparatus which permits improved assemblability and which inhibits dust from entering through the back face of a supporting substrate of the keyboard apparatus.

To this end, according to one aspect of the present invention, there is provided a keyboard apparatus equipped with a supporting substrate having a retaining portion provided by cutting and raising such that it protrudes upward, and a vertical through hole resulting from the cutting and raising; wherein the bottom surface of the supporting substrate is provided with a dust-proof sheet to cover the through hole.

According to another aspect of the present invention, there is provided a keyboard apparatus equipped with a supporting substrate having a retaining portion provided by cutting and raising such that it protrudes upward, a vertical through hole formed by the cutting and raising; and a supporting member having a pair of slide retaining pins which are latched on the retaining portion and which protrude, opposing each other; wherein the retaining portion has a narrow area and a wide area, and the slide retaining pins are latched in the wide area of the retaining portion.

In a preferred form of the keyboard apparatus in accordance with the present invention, the narrow area of the retaining portion is formed to be narrower than the interval between the slide retaining pins, while the wide area of the retaining portion is formed to be wider than the interval between the slide retaining pins.

In another preferred form of the keyboard apparatus in accordance with the present invention, the bottom surface of the supporting substrate is provided with a dust-proof sheet to cover the hole.

DESCRIPTION OF THE PREFERRED EMBODIMENT

Figure 1:
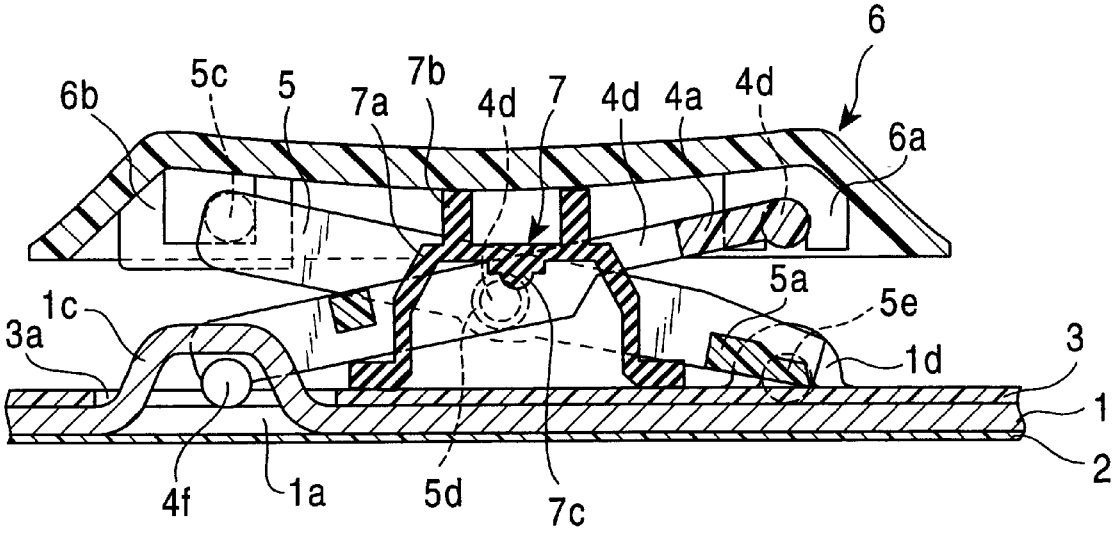
FIG. 1 is a sectional view of a keyboard apparatus in accordance with the present invention.
Figure 2A:
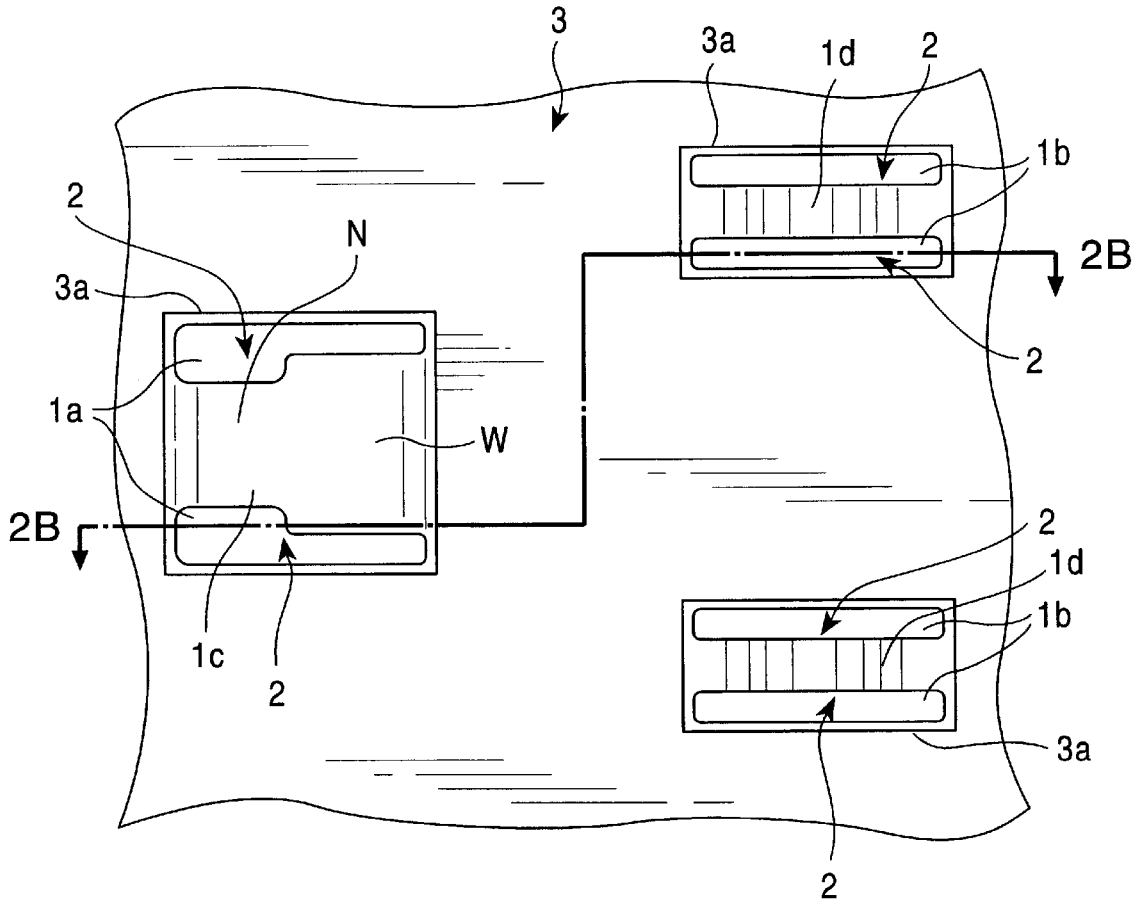
FIG. 2 is a schematic representation of a supporting substrate used for the keyboard apparatus in accordance with the present invention.
Figure 2B:
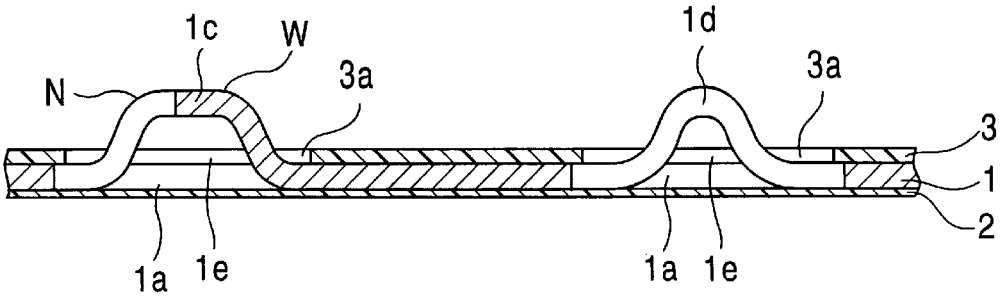
Figure 3:
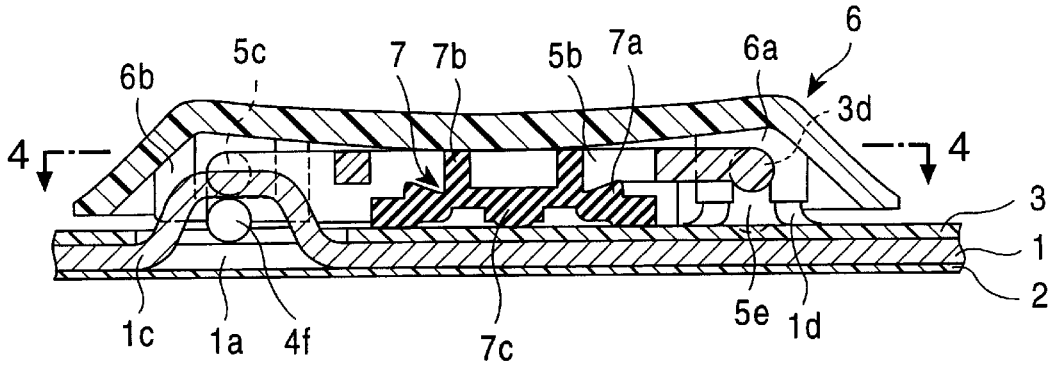
FIG. 3 is a schematic representation of the operation of the keyboard apparatus in accordance with the present invention.
Figure 4:
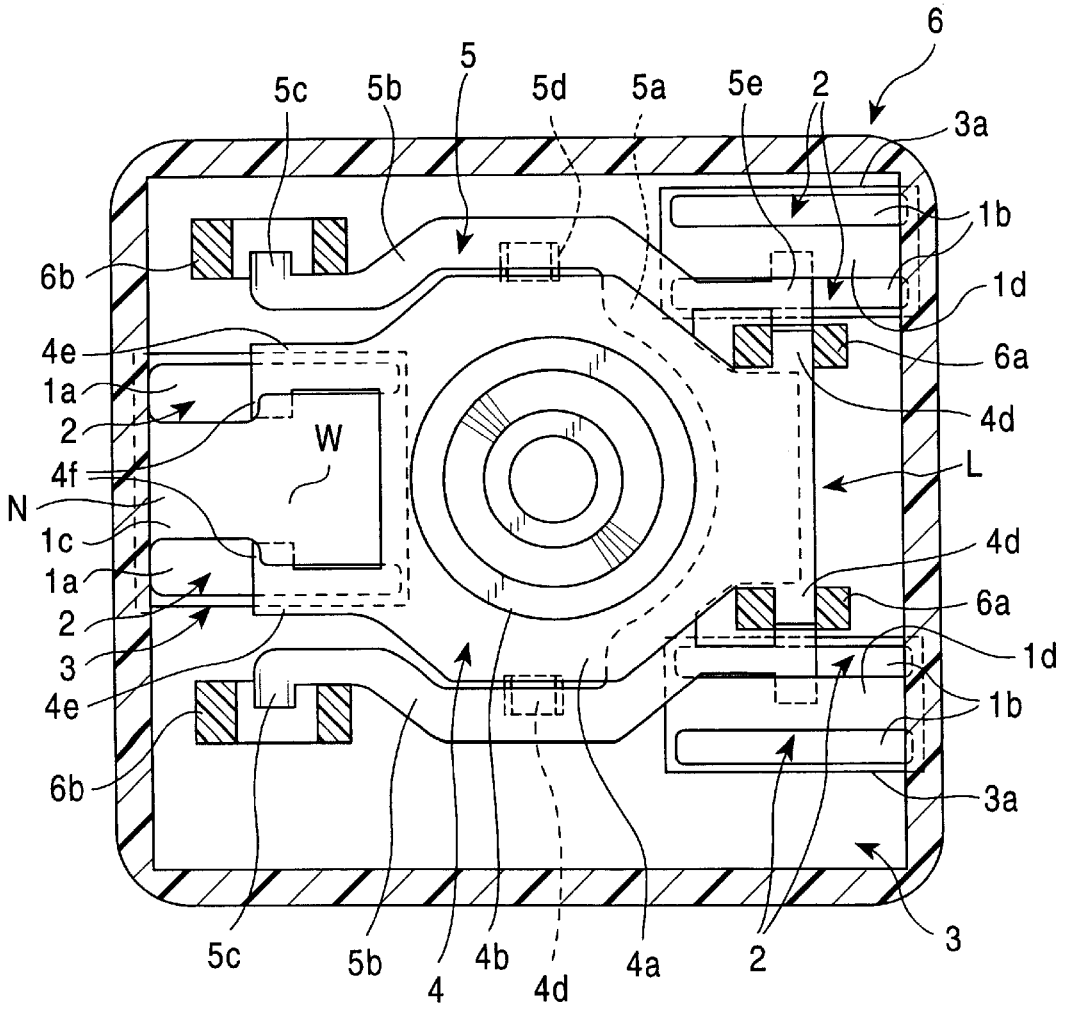
FIG. 4 is a sectional view taken at the line 4—4 of FIG. 3.
Figure 5A:
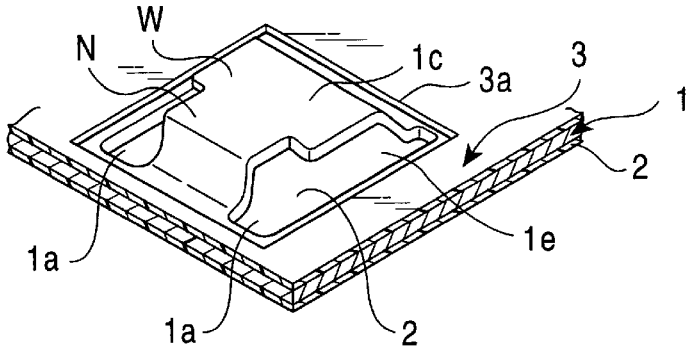
FIG. 5 is a schematic representation illustrative of the assembly steps of the keyboard apparatus in accordance with the present invention.

An embodiment of the keyboard apparatus in accordance with the present invention will be described in conjunction with the accompanying drawings. FIG. 1 is a sectional view of the keyboard apparatus in accordance with the present invention. FIG. 2 is a schematic representation of a supporting substrate used for the keyboard apparatus in accordance with the present invention, wherein FIG. 2A is a partial top plan view of the supporting substrate, and FIG. 2B is a sectional view taken at the line 2B—2B of FIG. 2A. FIG. 3 is a schematic representation illustrative of the operation of the keyboard apparatus in accordance with the present invention. FIG. 4 is a sectional view taken at the line 4—4 of FIG. 3. FIG. 5 is a schematic representation illustrative of the assembly steps of the keyboard apparatus in accordance with the present invention.

A plate-like supporting substrate 1 formed of a metal constituent has: a pair of L-shaped slits 1*a* provided in parallel and two pairs of rectangular slits 1*b* provided in parallel; a first retaining portion 1*c* which is positioned between the paired slits 1*a,* provided by cutting and raising a portion of the plate such that it has areas of different widths and protrudes upward above the supporting substrate 1, and has a trapezoidal section; two second retaining portions 1*d,* each of which is positioned between the slits 1*b* of each pair, provided by cutting raising square portions of the plate having the same widths so that they protrude upward above the supporting substrate 1, and have U-shaped sections; and vertical through holes 1*e* formed by providing the slits 1*a* and 1*b,* the first retaining portion 1*c,* and the second retaining portions 1*d*. As shown in FIGS. 2, 4, and 5, the first retaining portion 1*c* has a narrow area N located away from the second retaining portions 1*d* and a wide area W located closer to the second retaining portions 1*d*.

The single first retaining portion 1*c* and the two second retaining portions 1*d* are disposed triangularly on the supporting substrate 1. A plurality of sets, each set consisting of the three retaining portions, are formed on the supporting substrate 1.

A dust-proof sheet 2 formed of a synthetic resin is attached to the whole back face of the supporting substrate 1 by using an appropriate bonding method. The dust-proof sheet 2 may be provided so as to cover only the through holes 1*e* formed in the supporting substrate 1.

A contact sheet 3 composed of two layers of flexible resinous films (not shown) has printed contacts on two opposing surfaces of the resinous films disposed with a predetermined gap provided therebetween. The sheet 3 has a plurality of apertures 3*a*. The first retaining portion 1*c* and the second retaining portions 1*d* are mounted on the supporting substrate 1 by being inserted in the respective apertures 3*a*.

A link assembly L formed of a synthetic resin is constituted by a first supporting member 4 and a second supporting member 5. The first supporting member 4 is composed of: a plate-like base 4*a;* a round aperture 4*b* provided at the center of the base 4*a;* pivot shafts 4*c* installed on both sides at the center of the base 4*a;* a rotary shaft 4*d* which is provided around the pivot shafts 4*c* and which projects from the sidewall of one end of the base 4*a;* a pair of arms 4*e* which are provided around the pivot shaft 4*c,* coupled to the base 4*a* on the opposite side thereof, and protrude in parallel to each other; and slide retaining pins 4*f* provided so that they protrude inward with respect to the ends of the arms 4*e*.

The second supporting member 5 is constituted by a base 5*a,* a pair of arms 5*b* which are formed approximately in a U shape by being coupled to the base 5*a* and which are provided in parallel to each other, a slide pin 5*c* provided in such a manner that it protrudes outward on the free end of each of the arms 5*b;* a pair of pivot apertures 5*d* provided at the middle of each of the arms 5*b* such that they face each other; and a T-shaped rotary retaining pin 5*e* which is coupled to the base 5*a* and extends in the opposite direction from the arms 5*b*.

The first supporting member 4 and the second supporting member 5 are connected by pivot shafts 4*c* that are fitted from inside into the pivot apertures 5*d* so that they intersect with each other. The slide retaining pins 4*f* are slidably retained and held in the single first retaining portion 1*c,* and the rotary retaining pin 5*e* is rotatably retained and held in the two second retaining portions 1*d,* thus making up a set of retaining portions of the link assembly L.

A key top 6 formed of a molding of a synthetic resin has supporting portions 6*a* and 6*b* on the bottom surface thereof. The rotary shaft 4*d* of the first supporting member 4 and the slide pin 5*c* of the second supporting member 5 are retained by the supporting portions 6*a* and 6*b*, respectively.

A rubber spring 7 formed of a rubber constituent is constructed of a dome portion 7*a* which has a section shaped like an inverted U and a flat top surface, a cylindrical contact portion 7*b* provided on the top of the dome portion 7*a,* and a protuberance 7*c* provided so that it protrudes downward in the dome portion 7*a.* The bottom of the dome portion 7*a* of the rubber spring 7 is fixed onto the sheet 3 by an appropriate means, and the dome portion 7*a* is inserted in the round aperture 4*b* of the first supporting member 4 so that the contact portion 7*b* comes in contact with the bottom surface of the key top 6. The springiness of the dome portion 7*a* urges the link assembly L and the key top 6 upward at all times. At this time, the protuberance 7*c* provided at the bottom of the dome portion 7*a* is positioned above the sheet 3.

A plurality of the link assemblies L, the key tops 6, the rubber springs 7 configured as discussed above are arranged on the supporting substrate 1 and the sheet 3 to make up the keyboard apparatus. This keyboard apparatus is installed on a personal computer or the like. In using the personal computer, when the key top 6 is pressed downward against the springiness of the rubber spring 7, the link assembly L moves down with the intersecting point as its center. At this time, the slide retaining pins 4*f* slide in the first retaining portion 1*c,* while the slide pins 5*c* slide in the supporting portions 6*b,* causing the link assembly L to be collapsed. This squeezes and deforms the dome portion 7*a,* causing the protuberance 7*c* to push the contact sheet 3. The pushing force turns ON the contact provided on the sheet 3, so that the input signal of the key is transmitted to a control member (not shown) of the personal computer or the like. The moment the key top 6 is released, the deformed dome portion 7*a* resets itself by its own springiness, the link assembly L and the key top 6 accordingly restore their original conditions, and the contact of the sheet 3 turns OFF. In this way, the contact is turned ON/OFF.

Figure 5B:
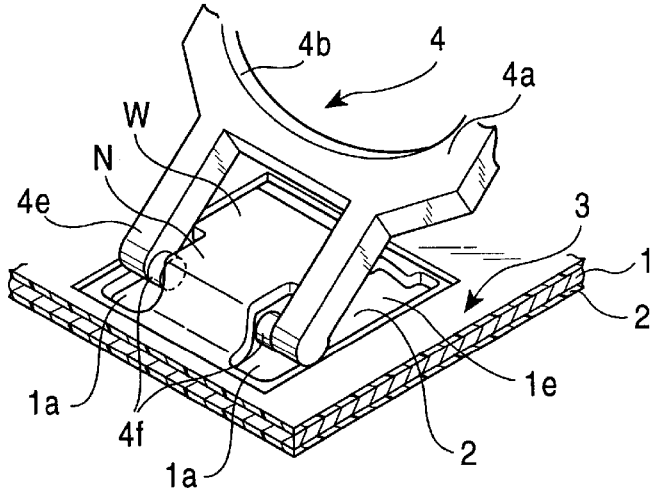
Figure 5C:
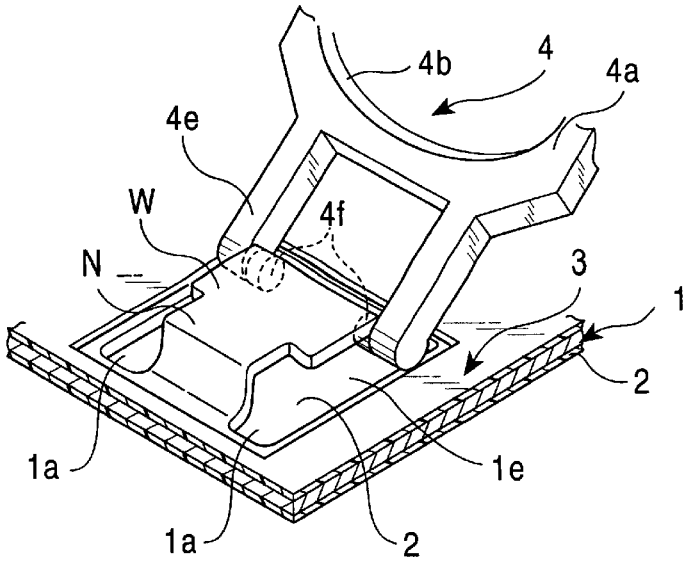
Figure 6:
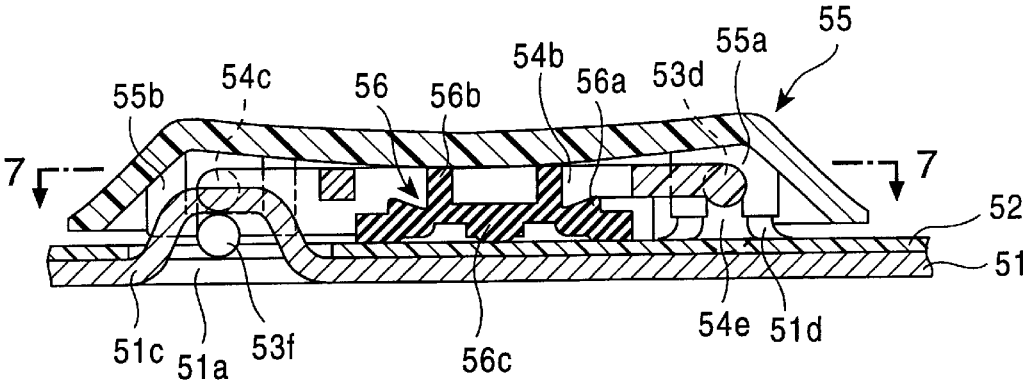
FIG. 6 PRIOR ART
FIG. 6 is a partial sectional view of a conventional keyboard apparatus.
Figure 7:
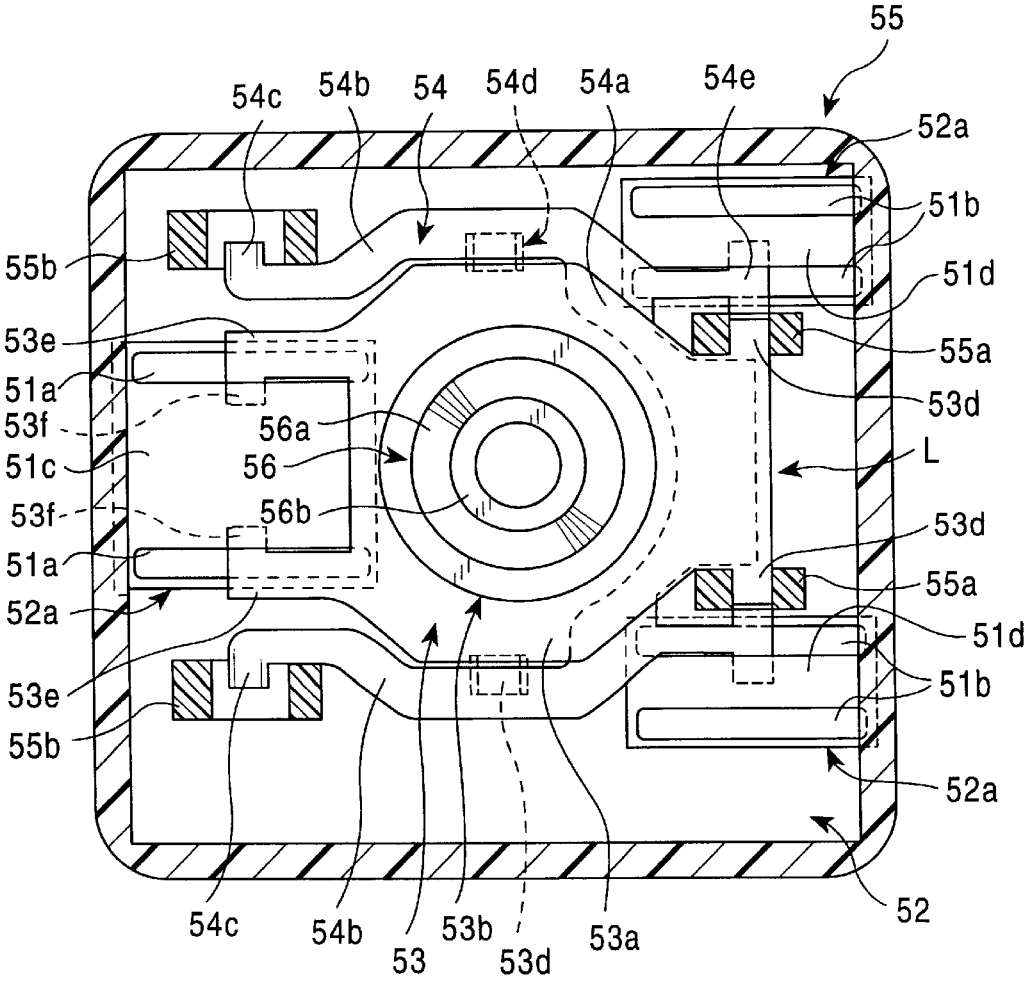
FIG. 7 PRIOR ART
FIG. 7 is a sectional view taken at the line 7—7 of FIG. 6.
Figure 8A:
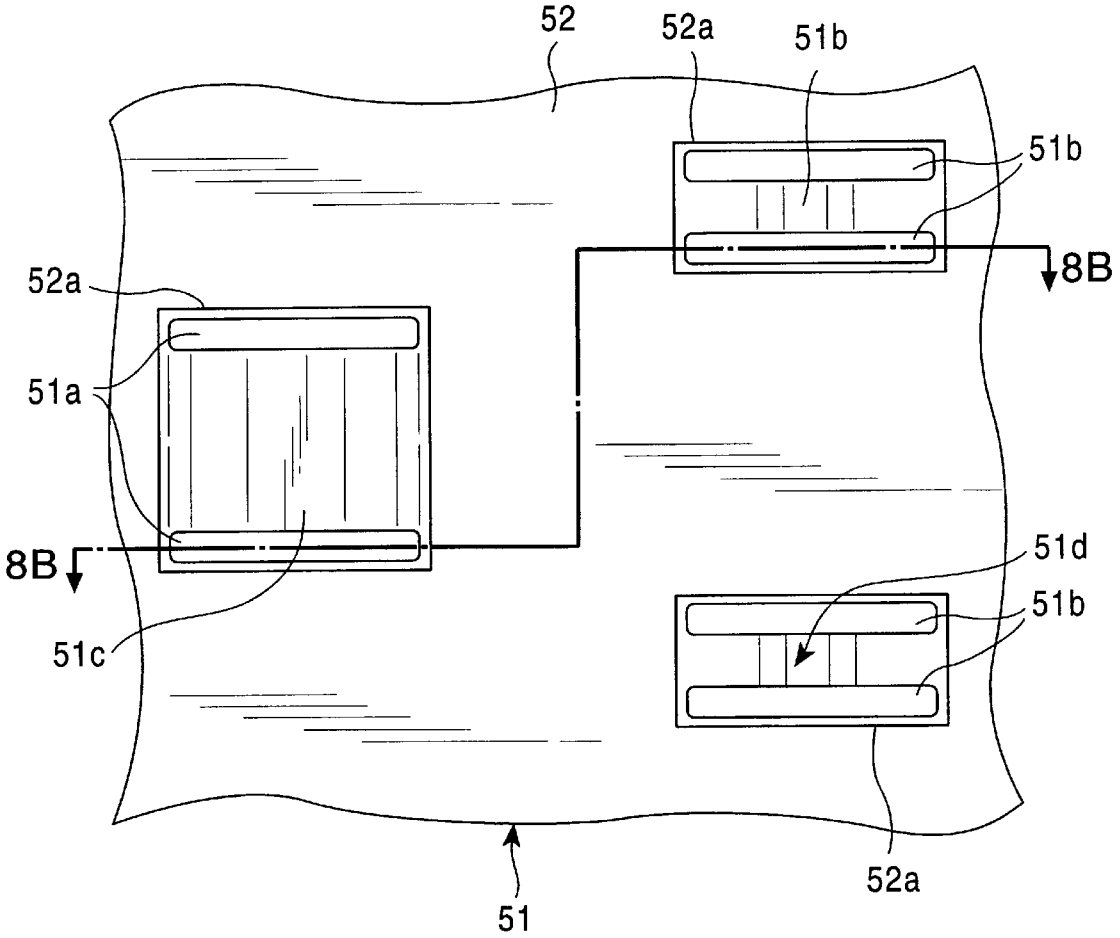
FIG. 8A PRIOR ART
FIG. 8 is a schematic representation of a supporting substrate used for the conventional keyboard apparatus.
Figure 8B:
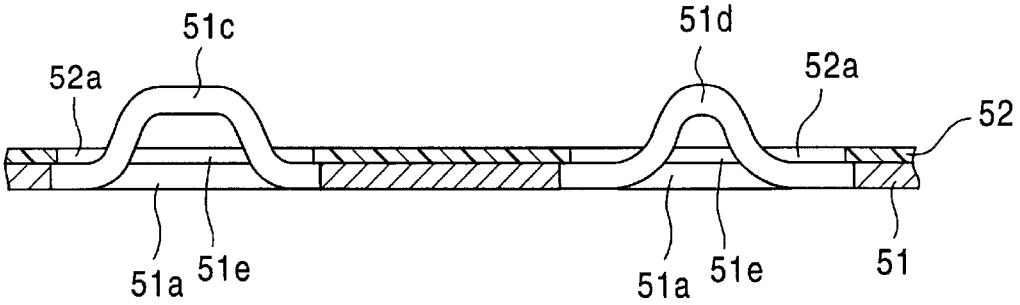
FIG. 8B PRIOR ART

The slide retaining pins 4*f* of the keyboard apparatus in accordance with the present invention are installed as follows: first, as shown in FIG. 5B, the slide retaining pins 4*f* are fitted to the first retaining portion 1*c* from above the narrow area N, which is slightly narrower than the interval between the two slide retaining pins 4*f.* Then, as illustrated in FIG. 5C, the slide retaining pins 4*f* are moved to the wide area W of the first retaining portion 1*c,* the wide area W being slightly wider than the interval between the two slide retaining pins 4*f.* In other words, the link assembly L is set back to its original state or upside so as to latch the slide retaining pins 4*f* to the bottom of the wide area W. This completes the installation of the slide retaining pins 4*f.*

The wide area W of the first retaining portion 1*c* has an appropriate length to prevent the slide retaining pins 4*f* from coming off the narrow area N by being released from the slidable engagement with the wide area W when the key top 6 is pressed to collapse the link assembly L or when the key top 6 is released and the slide retaining pins 4*f* slide in the first retaining portion 1*c.*

Thus, according to the keyboard apparatus of the present invention, the retaining portion has the narrow area and the wide area, and the slide retaining pins are latched on the wide area of the retaining portion. This permits improved assemblability of the keyboard apparatus since the slide retaining pins provided on the supporting member are attached to the retaining portion by inserting them from above the narrow area of the retaining portion in the assembly process of the keyboard apparatus.

Further, according to the keyboard apparatus of the present invention, the narrow area of the retaining portion is narrower than the interval between the slide retaining pins, while the wide area of the retaining portion is wider than the interval of the slide retaining pins. This permits easier installation of the slide retaining pins to the supporting substrate and enables the slide retaining pins to be securely held.

Moreover, according to the keyboard apparatus of the present invention, the bottom surface of the supporting substrate is provided with the dust-proof sheet to cover the apertures. This prevents adverse effect on the operation or the like of the supporting member by the intrusion of dust into the keyboard apparatus from the back face of the supporting substrate through the vertical through holes.

What is claimed is:

1. A keyboard apparatus comprising:

a supporting substrate having a retaining portion comprising a raised portion that protrudes upward, and a vertical through hole at least partially enclosed by the raised portion;

wherein a bottom surface of the supporting substrate is provided with a dust-proof sheet to cover the through hole;

wherein the raised portion comprises a narrow surface portion positioned above the supporting substrate unitarily joined to a wide surface portion positioned above the supporting substrate, the narrow surface portion having a width shorter than a distance between a first retaining pin having a first surface that projects inward and a second retaining pin having a second surface that projects inward and is positioned across from the first surface, the wide surface portion having a width greater than the distance between the first and the second retaining pin surfaces to latch more than one of the retaining pins.

2. A keyboard apparatus comprising:

a supporting substrate having a retaining portion comprising a raised portion that protrudes upward above the supporting substrate, a vertical through hole passing below the raised portion; and a supporting member having a pair of slide retaining pins which are latched by the raised portion and which protrude inward and have surfaces positioned across from each other such that they arc opposing each other;

wherein the raised portion comprises a narrow area unitarily joined to a wide area above the supporting substrate that are each formed of a material, and the slide retaining pins arc latched by the wide area of the raised portion.

3. A keyboard apparatus according to claim 2, wherein the narrow area of the retaining portion is formed to be narrower than the interval between the slide retaining pins, while the wide area of the retaining portion is formed to be wider than the interval between the slide retaining pins.

4. A keyboard apparatus according to claim 2, wherein a bottom surface of the supporting substrate is provided with a dust-proof sheet to cover the hole.

5. The keyboard apparatus according to claim 1, wherein the narrow surface portion and the wide surface portion have a substantially planar shape.

6. The keyboard assembly according to claim 1, wherein the first retaining pin is unitarily joined to the second retaining pin.

7. A keyboard apparatus comprising:

a supporting substrate having a retaining portion provided by cutting and raising such that it protrudes upward, and a vertical through hole resulting from the cutting and raising;

wherein a bottom surface of the supporting substrate is provided with a dust-proof sheet to cover the through hole;

wherein the retaining portion comprises a narrow surface portion unitarily joined to a wide surface portion, the narrow surface portion having a width shorter than a distance between a first retaining pin surface positioned across from a second retaining pin surface and the wide surface portion having a width greater than the distance between the first retaining pin surface and the second retaining pin surface wherein the retaining portion is separated from the supporting substrate by a pair of channels that are substantially symmetric and are each comprised of a polygonal portion joined to a rectangular portion.

8. The keyboard assembly according to claim 1, wherein the first and the second retaining pins are latched beneath the wide surface portion.

* * * * *

UNITED STATES PATENT AND TRADEMARK OFFICE

CERTIFICATE OF CORRECTION

PATENT NO. : 6,312,176 B2 
DATED : November 6, 2001
INVENTOR(S) : Masaaki Kageyama et al.

It is certified that error appears in the above-identified patent and that said Letters Patent is hereby corrected as shown below:

Column 6,
Line 67, delete "arc" and substitute -- are -- in its place.

Column 7,
Line 2, delete "arc" and substitute -- are -- in its place.

Signed and Sealed this

Twentieth Day of August, 2002

*Attest:*

*Attesting Officer*

JAMES E. ROGAN
*Director of the United States Patent and Trademark Office*